United States Patent [19]

Ulm

[11] 4,235,029

[45] Nov. 25, 1980

[54] MACHINE FOR CLEANING RAILWAY TRACKS

[76] Inventor: Raymond Ulm, R.R. 1, Delphos, Ohio 45833

[21] Appl. No.: 63,468

[22] Filed: Aug. 3, 1979

[51] Int. Cl.[3] ..... E01B 27/02

[52] U.S. Cl. ..... 37/104; 37/141 R; 104/279

[58] Field of Search ..... 37/104, 105, 106, 107, 37/126 R, 129, 141 R; 104/2, 279; 171/16

[56] References Cited

U.S. PATENT DOCUMENTS

| | | | |
|---|---|---|---|
| 305,911 | 9/1884 | Ferguson | 37/28 |
| 750,852 | 2/1904 | Hart | 37/104 X |
| 912,282 | 2/1909 | Cafferty | 37/104 |
| 1,208,809 | 12/1916 | Mann | 37/104 |
| 1,469,464 | 10/1923 | Ursino | 37/104 |
| 1,470,058 | 10/1923 | Clapp | 37/104 |
| 1,681,059 | 8/1928 | Sauvage | 188/200 |
| 2,268,570 | 1/1942 | Osgood | 414/682 |
| 2,374,312 | 4/1945 | Tackett | 37/104 |
| 2,505,501 | 4/1950 | Miller et al. | 15/55 |
| 2,583,378 | 1/1952 | Kershaw | 37/105 |
| 2,584,675 | 2/1952 | Dangerfield | 37/104 |
| 2,669,338 | 2/1954 | Kling | 198/513 |
| 2,748,720 | 6/1956 | Kling | 104/279 |
| 3,019,536 | 2/1962 | Kershaw | 37/104 |
| 3,305,952 | 2/1967 | Dressler | 37/104 |
| 3,468,042 | 9/1969 | Coy | 37/104 |
| 3,479,755 | 11/1969 | Schropp | 37/129 X |
| 3,624,936 | 12/1971 | Yard | 37/104 |
| 4,047,486 | 9/1977 | Pabsdorff | 37/106 |

FOREIGN PATENT DOCUMENTS

| | | | |
|---|---|---|---|
| 1658357 | 10/1970 | Fed. Rep. of Germany | 37/105 |

*Primary Examiner*—Clifford D. Crowder
*Attorney, Agent, or Firm*—Henry K. Leonard

[57] ABSTRACT

A machine for cleaning debris from railway roadbeds, particularly from between rails of a single track and the space between tracks in railroad yards, comprises an articulated tractor and scraper-loader, each preferably having only two wheels. The scraper-loader has a scraper blade which extends transversely to the track when the machine is in use and a notch which loosely fits over a rail. The blade has wings extending oppositely from the notch. One of the wings has a length which is substantially equal to, but no greater than, the distance between the rails of a track, and the other has a length equal to at least one-half of that distance. The blade has a shoe which overlies the notch and which rides on the surface of a rail to establish the depth of the blade relative to the rails. The shoe is adjustably mounted on the blade so that such depth can be varied in order to clean between the rails of tracks which have rails of different heigths above their ties. The scraper-loader has a storage compartment into which the debris is fed so that it can be re-used to fill low places in the roadbed or carried to a disposal site.

3 Claims, 5 Drawing Figures

FIG. 2
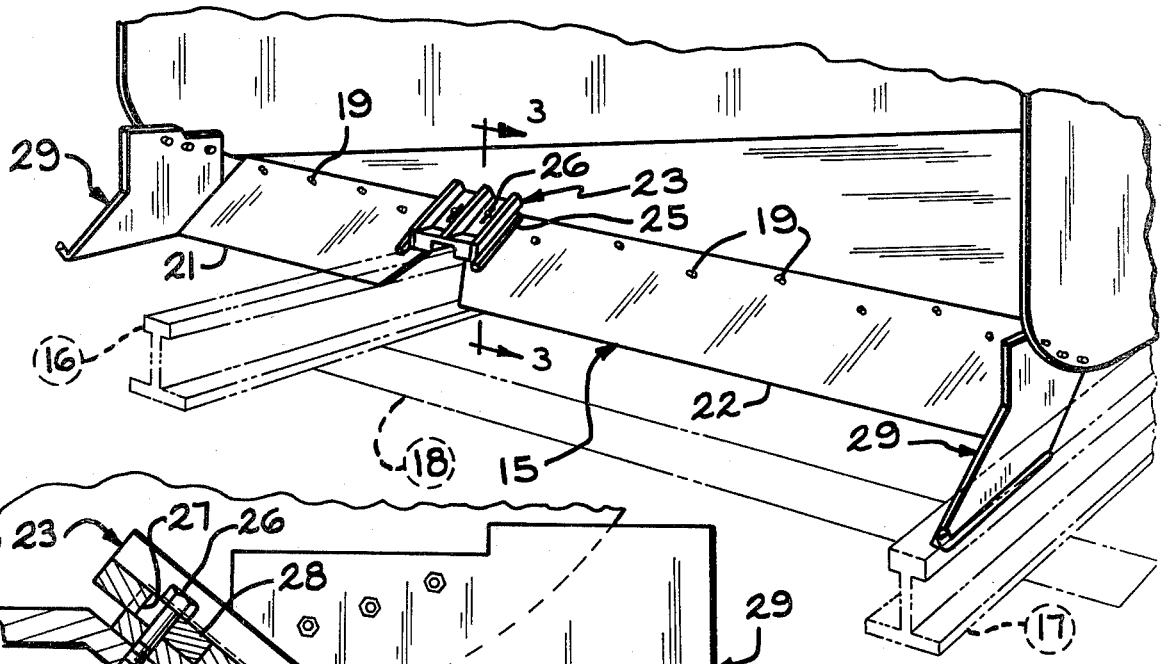
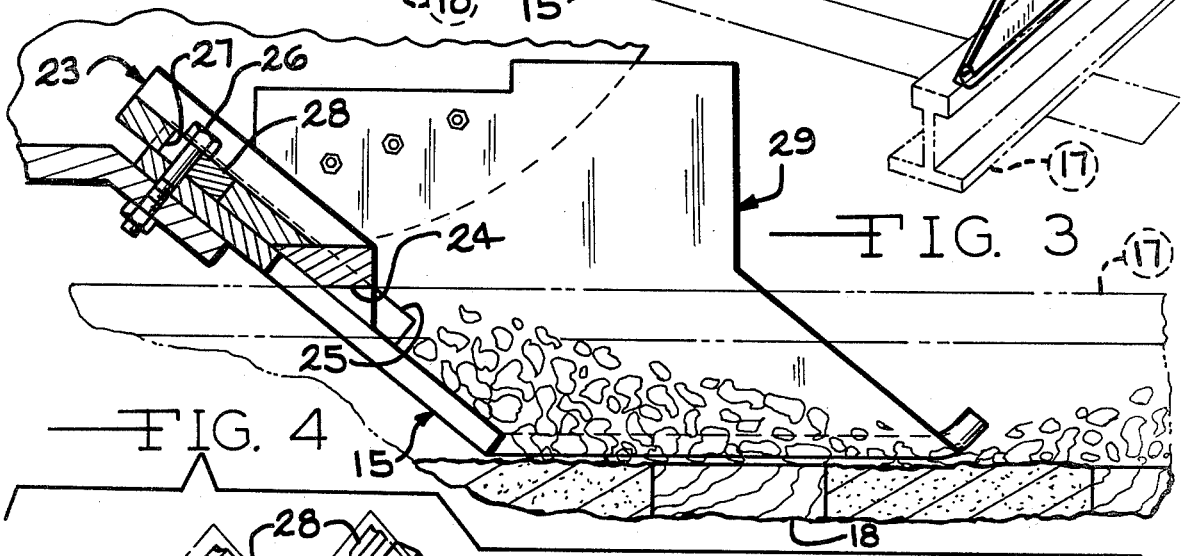
FIG. 3
FIG. 4
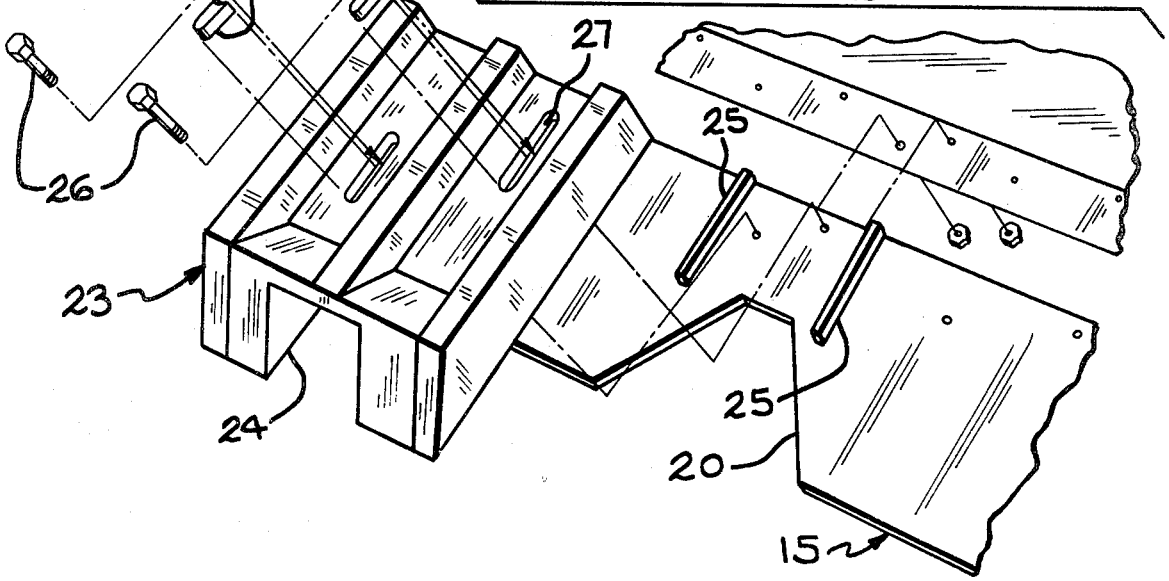

MACHINE FOR CLEANING RAILWAY TRACKS

BACKGROUND OF THE INVENTION

Some of the problems of maintaining a proper level of ballast between the ties of railroad tracks and between adjacent tracks and the removal of accumulated foreign debris from the spaces between the rails of individual tracks and between adjacent tracks, particularly in railroad yards, have been recognized in the past.

U.S. Pat. No. 2,748,720 to Kling discloses a large, expensive, apparatus which is designed for removing such materials from these areas. However, the apparatus of Kling was so designed and constructed that it has that use alone and has to be constructed with the track-cleaning object in mind. This makes the machine very expensive to build in the first place. In addition, the machine is designed on a rigid frame with wheels which span a single railroad track and with scraping means which are designed to ride both rails of a track and between the rails of the track, but laterally only to the ends of the ties of that particular track. The Kling machine does not have means for accumulation of the removed debris in the machine itself, and, therefore, an auxiliary vehicle into which the debris is discharged by the Kling machine must be utilized for delivery of the debris to a dumping location.

As another example, a much simpler apparatus is disclosed in U.S. Pat. No. 3,305,952 to Dressler. This machine consists of a simple front-loader with an auxiliary scoop which cleans material from between the rails of a track and dumps it into a hopper carried on the front of the loader.

Because of the rigid frame of the Kling machine, crossing a plurality of railroad tracks, as in a yard, presents a problem due to the "racking" of the apparatus and the likelihood that where the tracks lie at different ground levels, the machine easily could get "hung up," unless extreme care were taken to cross the tracks at right angles.

It is the principal object of the instant invention to provide a machine for cleaning debris from railway roadbeds, including not only the spaces between the rails of a single track, but also the spaces between adjacent tracks.

It is yet another object of the instant invention to provide a machine for cleaning debris from railway tracks which has means for storing a large volume of removed debris in the apparatus so that, from time to time, the debris can be delivered to a dumping location by the same machine. As a result, only one operator is necessary, both for the cleaning operation and for the delivery and dumping operation.

And yet another object of the instant invention is to provide a railway track cleaner which quickly can be moved away from the track it is cleaning in the event that railroad traffic is approaching on that track.

Yet another object of the instant invention is to provide a railway track cleaner which readily can be utilized not only to clear the spaces between the rails of a single track, but also the spaces between adjacent tracks, and which has the ability to simultaneously redeposit the cleared debris between the ties of a track or in the space between tracks where the level of the ballast is below the tops of the track ties.

And it is yet another object of the instant invention to provide a track cleaning adapter which readily can be mounted upon a standard articulated scraper-loader, preferably of the type having a two-wheel tractor and a two-wheel scraper-loader connected thereto.

BRIEF DESCRIPTION OF THE DRAWINGS

FIG. 2 is a fragmentary view in perspective particularly illustrating a scraper according to the invention;

FIG. 3 is a greatly enlarged, fragmentary, vertical sectional view taken generally along the line 3—3 of FIG. 2;

FIG. 4 is a fragmentary, exploded view of a portion of the scraper blade and its guide shoe according to the invention.

DESCRIPTION OF PREFERRED EMBODIMENT

A machine according to the invention will be described herein as being of such size as to clean United States standard gauge railway tracks which have their rails spaced from each other at 56½ inches between rail center lines. The customary spacing of adjacent tracks in railroad yards in the United States is 72 inches between the center lines of the near rails of the spaced tracks. It is to be realized that machines embodying the invention also may be designed for cleaning railway tracks of other gauges, for examples, the broad gauge of some European railways and the narrow gauge of other railways. The difference between the machine disclosed herein and a machine designed for clearing tracks of different gauge simply is that the dimensions of the scraper blade of the instant invention would be different.

Figure 1:
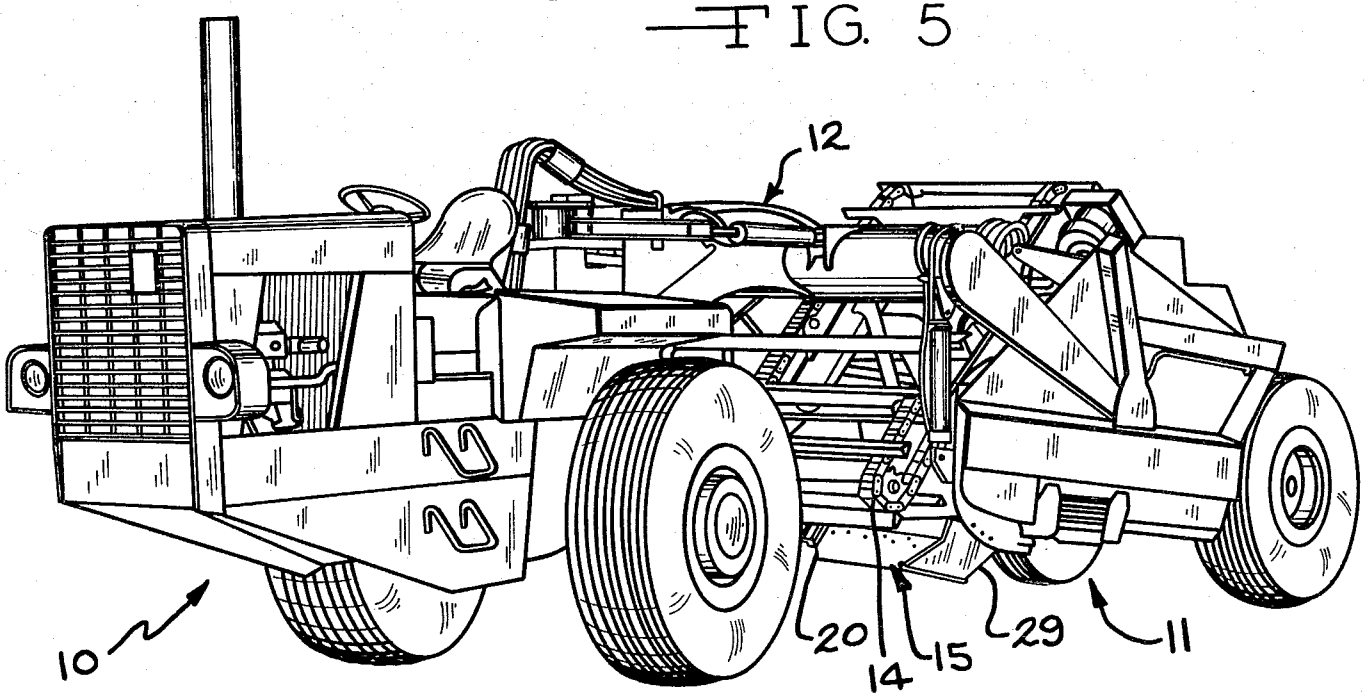
FIG. 1 is a view in perspective of an articulated tractor and scraper-loader equipped for cleaning roadbeds according to the invention.

The machine disclosed in FIG. 1 broadly consists of a two-wheeled tractor 10 and a two-wheeled scraper-loader 11 which are connected to each other by means of a heavy tang 12 rigidly mounted on the scraper-loader 11 and connected to the tractor 10 by an articulated connection (not specifically to be shown) which provides for rocking movements of the tractor 10 and the scraper-loader 11 relative to each other on axes in all three dimensions, i.e., horizontal, vertical, and transverse.

In addition, the scraper-loader 11 is so connected to the tractor 10 and heavy hydraulic means are provided by which the forward end of the scraper-loader may be raised and lowered relative to the level of the wheels of the tractor 10. The scraper-loader 11 has an interior storage compartment 13 which has an open front end and, also, a trap door (not shown) by means of which material accumulated in the storage compartment 13 may be discharged therefrom when desired. The scraper-loader 11 also has a power-driven, paddle-type conveyor 14 for moving material into the storage compartment 13.

According to the invention, the machine has a scraper blade, generally indicated by the reference number 15, which extends transversely of the machine and thus transversely of a track which is to be cleaned when the machine is in use. Two rails 16 and 17 are shown in phantom in FIG. 2 and a track tie 18 (also shown in phantom in FIG. 2) is fragmentarily illustrated in FIG. 3. The scraper blade 15 is mounted by a plurality of heavy bolts 19 at the front edge of the loading compartment 13 and extends downwardly therefrom at an angle. The blade 15 has a notch 20 which loosely fits over one of the two rails 16 or 17, as desired, according to the areas to be cleaned, as will be further described below.

The blade 15 has two wings 21 and 22 which extend oppositely from the notch 20, and the lower edges of which lie on the same horizontal plane. For use with standard gauge track in the United States, the shorter wing 21 preferably has a length of 36 inches from the center line of the notch 20 and the longer wing 22 has a length of 54 inches from the center line of the notch 20. By comparing these dimensions to the standard gauge of 56½ inches, it can be seen that the longer blade wing 22 will clear the area between adjacent tracks 16 and 17 when the machine is being operated with the blade 15 in the position illustrated in FIG. 2.

The machine also has a guide shoe 23 (see FIGS. 3 and 4) which has a track embracing notch 24 of such size that the shoe 23 rides on the load-bearing surface of the particular track 16 and 17 which it embraces. The shoe is adjustably mounted on the blade 15 by spaced ways 25 between which the shoe 23 is mounted and secured in position by heavy bolts 26, which extend through the blade 15 and through the front edge of the bottom of the compartment 13, as shown in FIG. 4. The shoe 23 is adjustably positionable on the blade 15, having elongated slots 27 through which the bolts 26 extend, and the particular position of the shoe 23 on the blade 15 is determined by the use of a selected pair of spacers 28 of such size that they fit into the slots 27 below the locking bolts 26 in order to deliver the thrust of the blade 15 to the bolts 26 and thus to the main structure of the bottom of the compartment 13.

Because rails vary in weight as much as from 90 pounds to 140 pounds per lineal yard, and thus their heights above their ties may very as much as one inch, spacers 28 are utilized so that the shoe 23 can be positioned on the blade 15 in order that the lower edge of the blade 15 just clears the upper surfaces of the ties, as illustrated in FIG. 3.

Preferably, the blade 15 also has a pair of outboard, vertical plates 29 carried by the sidewalls of the compartment 13 adjacent the ends of the blade wings 21 and 22, respectively, to prevent debris being scraped up by the blade 15 from falling laterally away from the machine.

Figure 5:
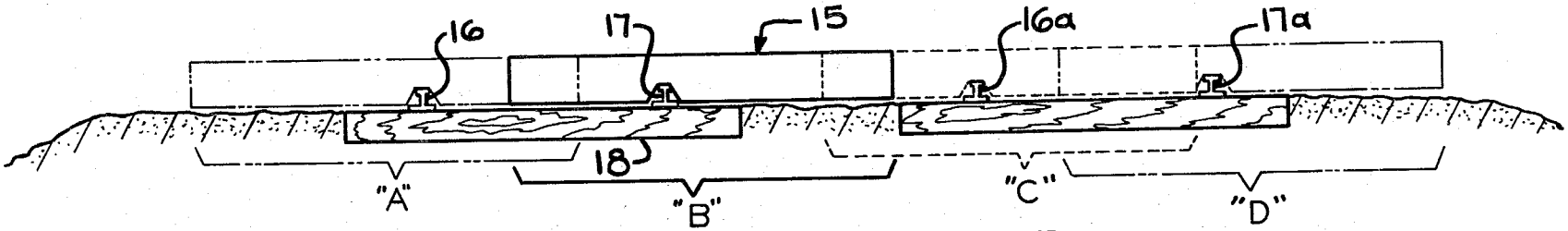
FIG. 5 is a diagramatic, transverse view of adjacent railway tracks illustrating how a machine embodying the invention is positioned for cleaning tracks as well as the space between adjacent tracks.

FIG. 5 specifically illustrates how a machine embodying the invention may be employed in a variety of relationships to a single track having rails 16 and 17 and also an adjacent track having rails 16*a*–17*a*. By reason of the fact that a machine embodying the invention is guided by only one of the tracks 16, 17, 16*a* or 17*a*, the area cleaned by the machine may be selectively varied. For examples, FIG. 5 illustrates four different alternative positions of the blade 15, as indicated by the brackets "A,""B," "C," and "D."

With the machine traveling along the rail 16 and the longer wing 22 extending outboard of the rail 16 (bracket "A"), the longer wing 22 clears not only the roadbed defined by the lateral extent of the ties 18 but also a considerable width of the outboard portion of the right-of-way beyond the ends of the ties 18. The shorter wing 21 in this position cleans somewhat more than one-half of the space between the rails 16 and 17, since its length is approximately 36 inches and the gauge is 56½ inches.

With the machine running along the rail 17 in the opposite direction (bracket "B"), the situation is reversed and the longer wing 22 clears the other side of the right-of-way while the shorter wing 21 overlaps the area cleared by the shorter wing 21 when the machine is going in the first direction. By thus traveling along one rail 16 in one direction and its companion rail 17 in the opposite direction, the space between the rails 16 and 17 is fully cleaned, as well as a considerable area of the roadbed outside of the rails 16 and 17 of a single track.

Where there exists an adjacent track comprising the rails 16*a* and 17*a*, it is conventional that the rail 16*a* be spaced from the rail 17 a distance of six feet, as in a yard having a multiplicity of parallel tracks, for example, in the "ladder" of a "hump." With the machine running along the track 16*a* and the shorter wing 21 extending outboard of the track 16*a* (bracket "C"), the area cleaned by the shorter wing 21 overlaps the area previously cleaned by the longer wing 22, as indicated by the bracket "B." In this arrangement the longer wing 22 fully clears the space between the track 16*a* and 17*a*. By then running the machine along the track 17*a* (bracket "D"), the right-of-way outboard of the track 17*a* is fully cleared to the extent of the wing 22.

The machine embodying the invention not only has the flexibility of utilization illustrated in FIG. 5 for readily cleaning the spaces between the rails of a single track, but also for cleaning areas outboard of those rails and between adjacent tracks, and the cleaning action may readily be accomplished by operating the machine in selected directions along the several tracks.

Because of the articulated connection between the tractor 10 and the scraper-loader 11 which carries the improved blade 15 of the invention, the machine can be utilized to clean tracks in busy locations, it being possible to raise the front of the scraper and drive off of a track at a sufficiently sharp angle to quickly clear the track for railroad traffic.

Having described my invention I claim:

1. A machine for cleaning debris from railway roadbeds, particularly from between the rails of a track and between adjacent tracks, said machine comprising:

(a) a tractor having a short turning radius and wheels of such size that said tractor is capable of crossing railway tracks, (b) a scraper-loader, having wheels and a load-carrying compartment which has a horizontally-extending, open front end, (c) power means for raising and lowering the front end of said compartment relative to the level of said wheels, (d) a scraper blade mounted on said scraper-loader at the front end of said compartment and having (1) a notch therein which loosely embraces one of the rails of the track, (1) two wings extending in opposite directions from the notch and having horizontally aligned lower edges, the first one of said wings having a length substantially equal to but no greater than the distance between the flanges of the rails of a track, and the second of said wings having a length at least equal to half of such distance, (e) a shoe mounted on said blade in overlying position relative to the notch in said blade, said shoe (1) having a notch which closely embraces one of the rails, and (2) a bearing surface at the base of the notch which rides on the wheel-engaging surface of said rail, (f) means for clamping said shoe in various adjusted positions relative to the lower edge of said blade, and (g) articulated pivot means connecting said tractor and said scraper-loader.

2. A machine according to claim 1 in which the means for clamping the shoe consists of parallel ways on the blade which extend perpendicularly to the lower edge of said blade, bolts which (a) extend through elongated slots in the said shoe which are parallel to said ways and (b) which extend through said blade, and spacers which fit into the slots below said bolts for spacing said shoe relative to said lower edge of said blade.

3. A machine for cleaning debris from railway beds, particularly from the rails of a track and between adjacent tracks, said machine comprising (a) a two wheeled tractor having wheels of such size that said tractor is capable of crossing railway tracks, (b) a scraper-loader, having at least two wheels capable of crossing railway tracks and a load carrying compartment, (c) means for universally pivotally connecting said tractor and said scraper-loader, thereby permitting the machine to turn about a short radius, (d) a scraper blade assembly mounted on said scraper-loader forwardly of said load carrying compartment, (e) power means for raising and lowering said scraper blade assembly relative to the level of said wheels of said scraper-loader, (f) said scraper blade assembly having (1) a single notch therein which loosely embraces one of the rails of the track, (2) two wings extending in opposite directions from said notch and having horizontally aligned lower edges, the first one of said wings having a length substantially equal to but not greater than the distance between the flanges of the rails of the track, and the second of said wings having a length at least equal to half of such distance, and (g) a positioning shoe rigidly mounted on said scraper blade in overlying relationship to the notch in said blade, said shoe (1) having an opening which closely embraces said one of the track rails, and (2) means on said shoe engaging the top surface of said one track rail to vertically position said scraper blade assembly.

* * * * *